US005884810A

United States Patent [19]

Vizcarra et al.

[11] Patent Number: 5,884,810

[45] Date of Patent: Mar. 23, 1999

[54] DISPENSER HAVING A BREAKABLE AND REPLACEABLE MEMBRANE FOR A RIGID CONTAINER FOR LIQUIDS

[76] Inventors: Carlos Bartning Rodriguez Vizcarra; Carlos Bartning Diaz, both of Circuito De Los Diamantes No. 161, Joyes Del Pedregal, Mexico

[21] Appl. No.: 790,445

[22] Filed: Jan. 29, 1997

Related U.S. Application Data

[63] Continuation-in-part of Ser. No. 458,127, Jun. 29, 1994, abandoned.

[51] Int. Cl.[6] ..... B67D 5/00

[52] U.S. Cl. ..... 222/83; 222/90

[58] Field of Search ..... 222/81, 83, 90, 222/185.1, 541.2, 541.5, 541.6, 541.7, 562, 569, 478, 481.5; 137/318

[56] References Cited

U.S. PATENT DOCUMENTS

| | | | |
|---|---|---|---|
| 918,117 | 4/1909 | Blackwell . | |
| 2,373,373 | 4/1945 | Berg . | |
| 3,474,933 | 10/1969 | Malpas . | |
| 4,325,496 | 4/1982 | Malpas . | |
| 4,610,374 | 9/1986 | Buehler | 222/83 |
| 5,152,438 | 10/1992 | Gordon et al. | 222/562 |
| 5,249,708 | 10/1993 | Magness . | |
| 5,402,915 | 4/1995 | Hogan | 222/105 |
| 5,467,896 | 11/1995 | Hols . | |

*Primary Examiner*—Philippe Derakshani
*Attorney, Agent, or Firm*—MacMillan, Sobanski & Todd, LLC

[57] ABSTRACT

A rigid container for liquids having an integrated dispenser is disclosed. The dispenser adapted to be received within an opening formed in the bottom of the container. The dispenser has a body which includes first and second flanges extending away from the body. These flanges define an annular outer recess therebetween which is adapted to receive a portion of said container wall. The dispenser body is supported within the container bottom opening such that the outer flange abuts an outer surface of the container wall and the inner flange abuts an inner surface of the wall. The dispenser also includes a thin, breakable membrane which extends across a recess formed in an inner portion of the dispenser body. The breakable membrane initially seals the container opening when the dispenser is positioned in the container wall. The breakable membrane is broken when a dispensing key is inserted within the dispenser inner recess. The breakable membrane may include a ring located adjacent its outer peripheral edge. The ring has a reduced thickness as compared to the thickness of the remaining portion of the breakable membrane for assisting the dispensing key in rupturing the membrane.

20 Claims, 4 Drawing Sheets

DISPENSER HAVING A BREAKABLE AND REPLACEABLE MEMBRANE FOR A RIGID CONTAINER FOR LIQUIDS

CROSS REFERENCE TO RELATED APPLICATION

This application in a continuation-in-part of U.S. patent application, Ser. No. 08/458,127, filed Jun. 29, 1994 now abandoned.

STATEMENT REGARDING FEDERALLY-SPONSORED RESEARCH OR DEVELOPMENT

Not applicable.

BACKGROUND OF THE INVENTION

This invention relates to rigid containers for liquids having an integrated dispenser supported within assessment an opening in the wall of the container. More particularly, this invention relates to an integrated dispenser having a breakable membrane which is ruptured by a dispensing key or valve inserted within the dispenser for extracting the liquid in the interior of the container.

Many of the rigid containers for liquids in use today consist of a body of blown plastic material. Typically, these containers are jugs or bottles which have a cylindrical or rectangular body shape connected to a neck portion having a top opening for filling the container. These containers are made in a number of different sizes and capacities. For all types of containers, a mechanism for extracting the liquid easily and practically is usually required. In some cases, the liquid may be extracted by a manual or electric pump. More commonly, the container may be used with a stand and inverted to allow the liquid to flow out of the top opening. This latter approach is often impractical because of the weight of the filled containers. For example, a jug which contains 19 liters (5 gallons) of water weighs approximately 19 kg (40 lb.). Ideally, it is desirable to provide a dispenser which is disposed within an opening in the container and which does not require the container to be inverted to dispense the liquid.

A number of containers having integrated dispensers are known. However, many of these containers having integrated dispensers are flexible bag-like structures. Accordingly, the manner in which the dispenser is secured within these flexible containers differs significantly from the manner in which an integrated dispenser is supported within a rigid container. Ideally, it would be desirable to provide a simple and cost-effective integrated dispenser having a structure which is suitable for a rigid container. In addition, it would be desirable to provide an integrated dispenser which is replaceable, thereby allowing the container to be refilled and reused a number of times.

SUMMARY OF THE INVENTION

This invention relates to an integrated dispenser for a rigid container for liquids which does not require a collapsible plastic liner or bag inside the container. The container is suitable for liquids that are not exposed to long storage periods and are not substantially affected by contact with air, such as purified water or other liquids that by their own nature do not suffer degradation. In operation, the liquid in the container is consumed in a few days or weeks, and once the liquid is finished, the container may be returned to the bottler for washing and refilling with liquid.

The integrated dispenser of this invention includes a hollow body having an outer flange, an inner flange and a breakable membrane. The hollow body has an outer shape and size which allows it to fit tightly within an opening located near the bottom of the container. The outer and inner flanges extend generally transversely from the outer surface of the body and define an annular recess therebetween. This outer recess receives a portion of the wall of the container so as to support the dispenser body within the opening of the container. The dispenser also has a recess formed in an inner portion of the body. This inner recess is adapted to receive a dispensing key or valve for use in extracting the liquid. A relatively thin, breakable membrane is attached to the end of the hollow body which extends inside of the container. The breakable membrane covers the inner recess of the dispenser body so as to seal the dispenser and the container opening. When the dispensing key is inserted into the dispenser inner recess, it ruptures the breakable membrane and allows the liquid to be dispensed from the container.

In a first embodiment of the invention, the dispenser has a built-in design which allows the dispenser to be integrated simply and firmly to the container. The outer flange abuts the outer surface of the wall of the container while the inner flange abuts the inner surface of the wall. In this configuration, the wall of the container is lodged under pressure between the outer and inner flanges. At least one protrusion may extend inwardly into the inner recess of the dispenser body. The dispenser key may include a hollow conduit having a beveled first end, a second end, and a disk disposed around an outer surface of the conduit between the first end and the second end. When the key is inserted within the dispenser inner recess, the disk abuts the outer flange and the beveled first end of the key ruptures the breakable membrane. The key may also include a ring disposed on the outer surface of the conduit. The ring may be located between the disk and the beveled first end of the conduit. Once the key is inserted within the dispenser opening such that the disk abuts the outer flange, the ring on the key abuts the protrusion on the inner surface of the dispenser recess so as to retain the key within the dispenser.

In a second embodiment of the invention, the integrated dispenser is a flexible and disposable member which allows the container to be refilled and reused a number of times. The inner flange of this embodiment may be tapered to allow the dispenser to be inserted into the container opening from outside the container. The taper of the inner flange is sized such that the disposable dispenser can be easily inserted and removed and conveniently replaced with a new dispenser. The breakable membrane in this embodiment may be thinner around its peripheral edge so as to assist the dispensing key in rupturing the membrane. In addition, the dispensing key may be press fit within the dispenser so as to secure it in place within the dispenser.

In operation, a container having an integrated dispenser is washed and filled through a filling neck located at the top of the container. The filling neck may be sealed with a cap. Upon receiving the product, the consumer perforates the flexible membrane of the dispenser with the dispenser key. If the container is provided with a sealing cap, the cap is broken in order to allow air to enter the container and avoid negative pressure from being produced inside the container when the liquid is withdrawn through the dispenser key. Once the container is empty, the dispenser key may be removed and the container returned empty to the bottler. The bottler will remove and replace the sealing cap and the dispenser with new components, thus starting the above process again.

Various objects and advantages of this invention will become apparent to those skilled in the art from the following detailed description of the preferred embodiment, when read in light of the accompanying drawings.

DETAILED DESCRIPTION OF THE PREFERRED EMBODIMENT

Figure 1:
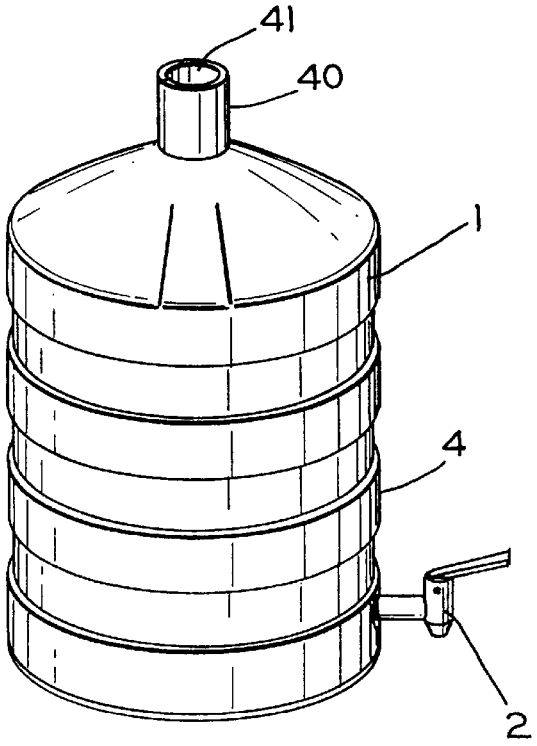
FIG. 1 is a side perspective view of a rigid container having a dispensing key or valve disposed therein.
Figure 2:
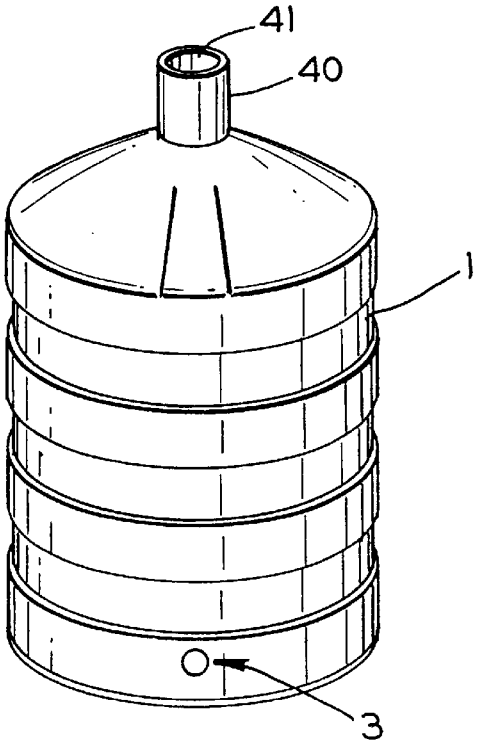
FIG. 2 is a front perspective view of the rigid container shown in FIG. 1 without the dispensing key.

Referring now to the drawings, there is illustrated in FIGS. 1 and 2, a rigid container 1 for liquids which does not require a collapsible bag or plastic liner inside of the container. The container 1 may be made from any rigid material such as plastics, glass, or ceramics. Furthermore, the container 1 used with this invention may be any type, shape, and size such as square or round bottles, barrels, jugs, or other vessels. FIG. 1 further shows a dispensing key or valve 2 which is disposed within a wall 4 of the container 1. The dispensing key 2 is in fluid communication with the interior of the container 1 so as to extract the liquid contained therein whenever the key 2 is operated. FIG. 2 shows an opening or outlet 3 into which the dispensing key 2 is inserted. Generally, the opening 3 is located near the bottom of the container 1 so as to allow the majority of the liquid to be extracted from the container 1.

Figure 3:
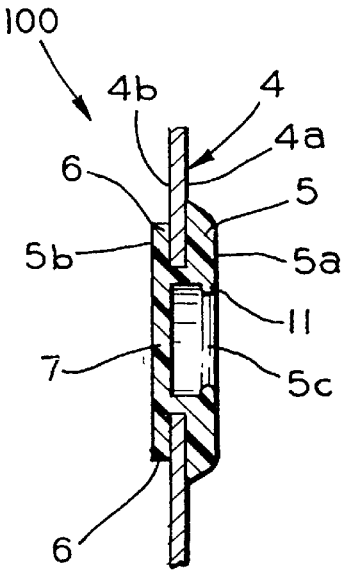
FIG. 3 is a cross sectional side view of a first embodiment of a dispenser in accordance with this invention disposed within the wall of a rigid container.
Figure 4:
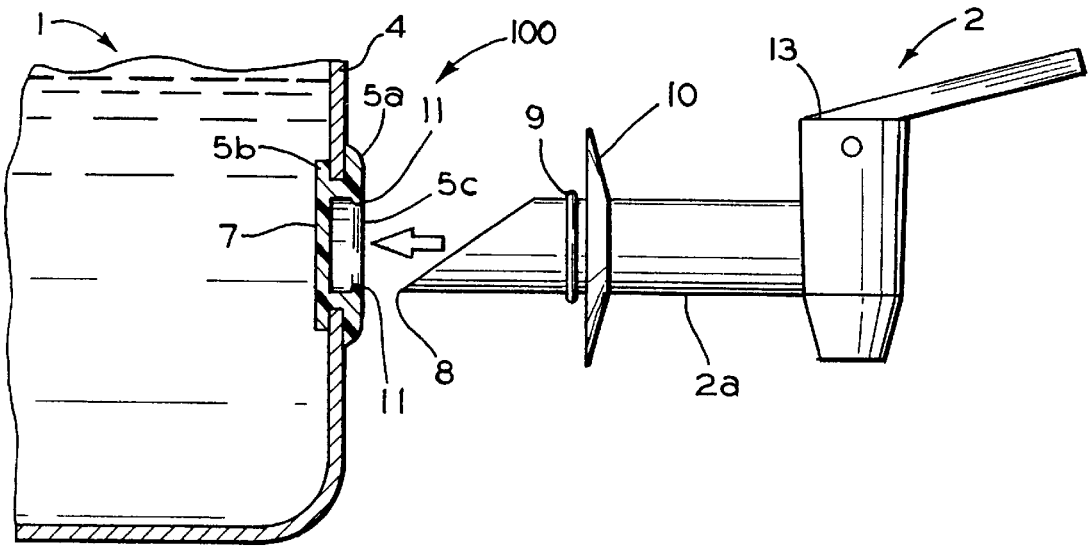
FIG. 4 is a cross sectional side view of the dispenser shown in FIG. 3 and a first embodiment of a dispensing key before it is inserted within the dispenser.
Figure 5:
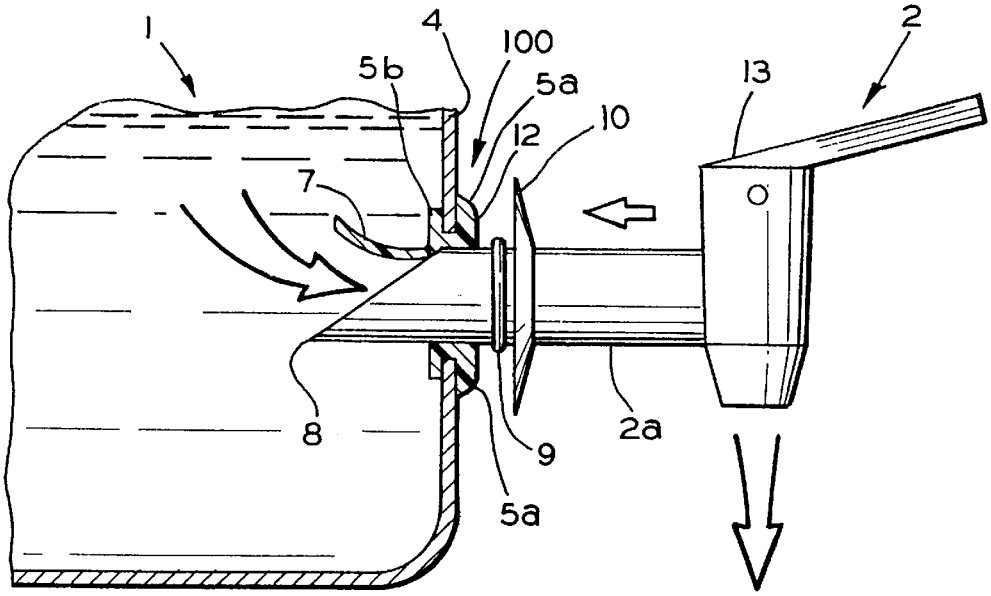
FIG. 5 is a view similar to that shown in FIG. 4 except that the dispensing key has been partially inserted within the dispenser.
Figure 6:
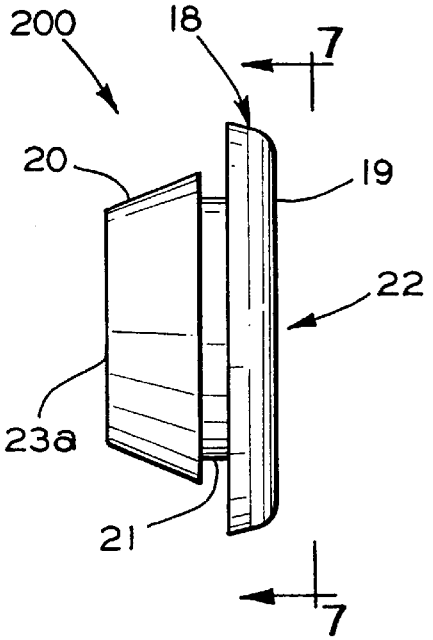
FIG. 6 is a side view of a second embodiment of a dispenser in accordance with this invention.

A first embodiment of an integrated dispenser in accordance with this invention is indicated generally at 100 in FIGS. 3 through 5. As seen in FIG. 3, the dispenser 100 includes a hollow body, indicated generally at 5, having a first outwardly extending outer flange 5*a* and a second outwardly extending inner flange 5*b*. The outer flange 5*a* and the inner flange 5*b* extend away from the hollow body 5 to define an annular outer recess 6 therebetween. The annular recess 6 is adapted to receive a portion of the wall 4 of the container 1 so as to support the body 5 of the dispenser 100 within the opening 3. In this configuration, the wall 4 of the container 1 is lodged under pressure between the outer flange 5*a* and the inner flange 5*b*. The outer flange 5*a* abuts the outer surface 4*a* of the wall 4 while the inner flange 5*b* abuts the inner surface 4*b* of the wall 4.

Figure 3A:
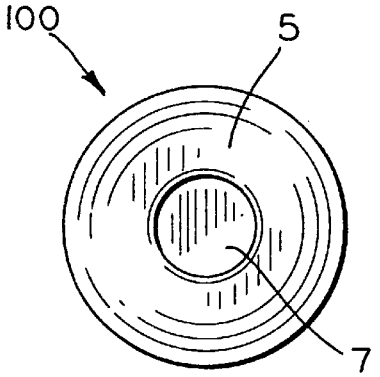
FIG. 3*a* is a front view of the dispenser shown in FIG. 3.

The body 5 of the inventive dispenser 100 may also include a recess 5*c* formed in an inner portion of the body. The inner recess 5*c* is adapted to receive a dispensing key 2 as shown in FIGS. 1 and 5. The body 5 may also include at least one protrusion 11 which extends inwardly into the inner recess 5*c*. As shown in FIG. 3, a breakable membrane 7 extends across the inner portion of the body 5. Initially, the membrane 7 is intact so as to seal the recess 5*c* and the opening 3 of the container 1 when the dispenser 100 is disposed within the opening 3. The breakable membrane 7 is made from a resistant, flexible material which is capable of being ruptured or broken by the dispensing key 2 when it is inserted within the dispenser 100. The membrane 7 may be relatively thin compared to other portions of the body 5, such as the outer flange 5*a* and the inner flange 5*b*. FIG. 3*a*, which is a frontal view of the inventive dispenser 100, shows the body 5 and the breakable membrane 7.

FIG. 4 shows a first embodiment of a dispensing key 2 before it is inserted into a dispenser 100. In general, the dispensing key 2 is a hollow conduit 2*a* which may include a spout 8 on the end to be inserted in the dispenser 100. The spout 8 may have a beveled tip to assist in rupturing the breakable membrane 7 when the key 2 is inserted within the dispenser 100. As seen in FIG. 5, once the key 2 is inserted within the dispenser 100 and breaks the membrane 7, the liquid in the container 1 can flow through the conduit 2*a* of the dispensing key 2.

The dispensing key 2 may also include a ring 9 and a disk 10 which are disposed on the outer surface of the conduit 2*a*. When the dispensing key 2 is inserted a sufficient distance into the dispenser 100, the ring 9 advances beyond the protrusion 11 found in the inner recess 5*c* of the dispenser 100 body 5. The protrusion 11 and ring 9 function together to retain the key 2 within the dispenser 100. The disk 10 abuts the outer surface 12 of the first flange 5*a* so as to seal the dispensing key 2 and dispenser 100 and prevent leakage of liquid from the container 1. The disk 10 also functions to limit the distance in which the key 2 can be inserted or advanced within the inner recess 5*c* of the dispenser 100.

The dispensing key 2 may have a valve 13 or other flow control means disposed on the end opposite the spout 8. The valve 13 can be any of the known types including, but not limited to, ball, gate, globe, needle, or plug valves. The valve 13 can be selectively opened and closed to extract the liquid from the container 1 once the dispensing key 2 is inserted within the dispenser 100 as shown in FIG. 5.

A second embodiment of an integrated dispenser 100 in accordance with this invention is shown in FIGS. 6 through 10. In this second embodiment, the dispenser 200 is a flexible and disposable member which is adapted to be inserted in the opening 3 of a refillable container 1. Referring to FIGS. 6 through 9, the disposable dispenser 200 includes a body 18 having a first outer shoulder or flange 19 and second inner flange 20. The first and second flanges 19 and 20 define an annular outer recess 21. The body 18 also includes a recess 22 formed in an inner portion of the body. The dispenser 200 also includes a breakable membrane 23 which covers the end 23*a* of the body 18 which extends inside the container 1.

Figure 9:
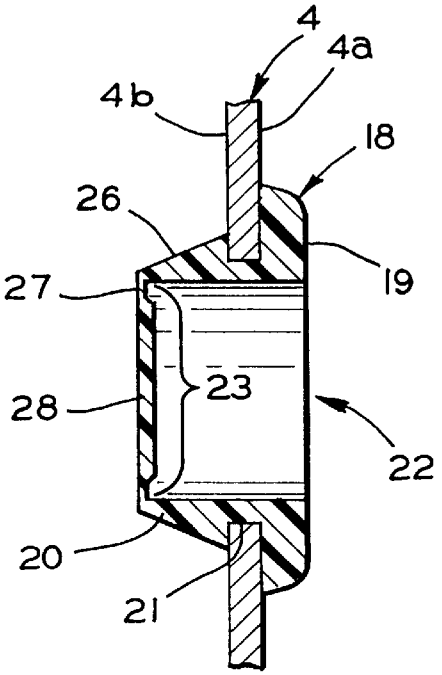
FIG. 9 is a cross sectional side view of the dispenser shown in FIG. 6 disposed within the wall of a rigid container.

As shown in FIG. 9, the wall 4 of the container fits within the outer recess 21 so as to support the body 18 within the opening 3 of the container 1. A first sealing surface 24 on the outer flange 19 abuts the outer surface 4*a* of the wall 4. A second sealing surface 25 on the inner flange 20 abuts the inner surface 4*b* of the wall 4. Both the first and second 25 sealing surfaces 24 and 25 produce pressure on the perimeter of the opening 3 so as to prevent liquid from leaking from the container 1. The first sealing surface 24 also functions as a retaining element to prevent the disposable dispenser 200 from being pushed into the interior of the container 1 when a dispensing key 2 is inserted.

The inner flange 20 of the disposable dispenser 200 has a surface 26, which is optionally frustoconically-shaped as shown, to assist in the insertion of the dispenser 200 into the outlet 3 of the container 1. As seen from FIGS. 8 and 9, this outer surface 26 may be tapered such that the portion of the inner flange having the largest diameter is adjacent the inner wall 4*b* of the container 1. This widest portion of the inner flange 20 also forms the second sealing surface 25. The inner flange 20 and its second sealing surface 25 may be sized so that the dispenser 100 can be easily inserted and withdrawn through the opening 3 of the container 1.

Figure 7:
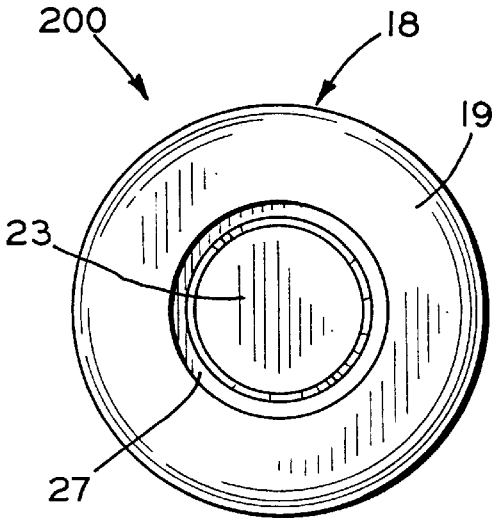
FIG. 7 is a front view of the dispenser shown in FIG. 6, taken along line 7-7.
Figure 8:
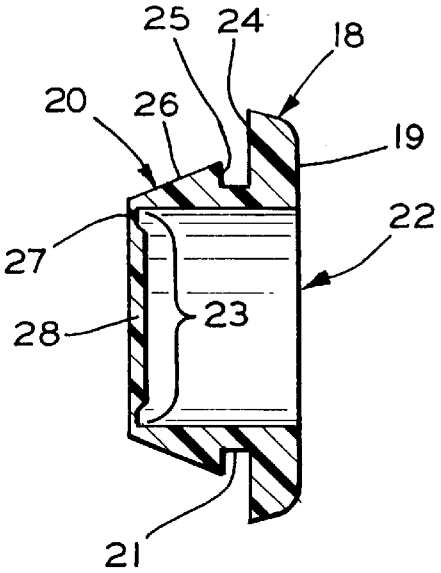
FIG. 8 is a cross sectional view of the dispenser shown in FIG. 6.

As shown in FIG. 7, the disposable dispenser 200 may also include a ring 27 around the outer periphery of the breakable membrane 23. Referring to FIGS. 8 and 9, the ring 27 is a portion of the membrane 23 which has a reduced thickness as compared to the thickness of the remaining portion 28 of the membrane 23. The thinner ring 27 of the membrane 23 helps the dispensing key 2 more easily break the wall of the membrane 23 when the key 2 is inserted therein.

The disposable dispenser 200 is assembled in the container 1 by inserting the end of the dispenser 200 having the breakable membrane 23 through the container opening 3. Sufficient force is then applied on the dispenser 200 so as to push the angular inner flange 20 beyond the wall 4 of the container 1. The dispenser 200 is inserted until the inside sealing surface 25 is sealed against the inside wall 4*b* of the container 1 and the outside sealing surface 24 is sealed against the outside wall 4*a*. The disposable dispenser 200 does not have any other retainer beyond the second sealing surface 25 and therefore, can be freely turned or rotated in the outlet 3 of the container 1.

Figure 10:
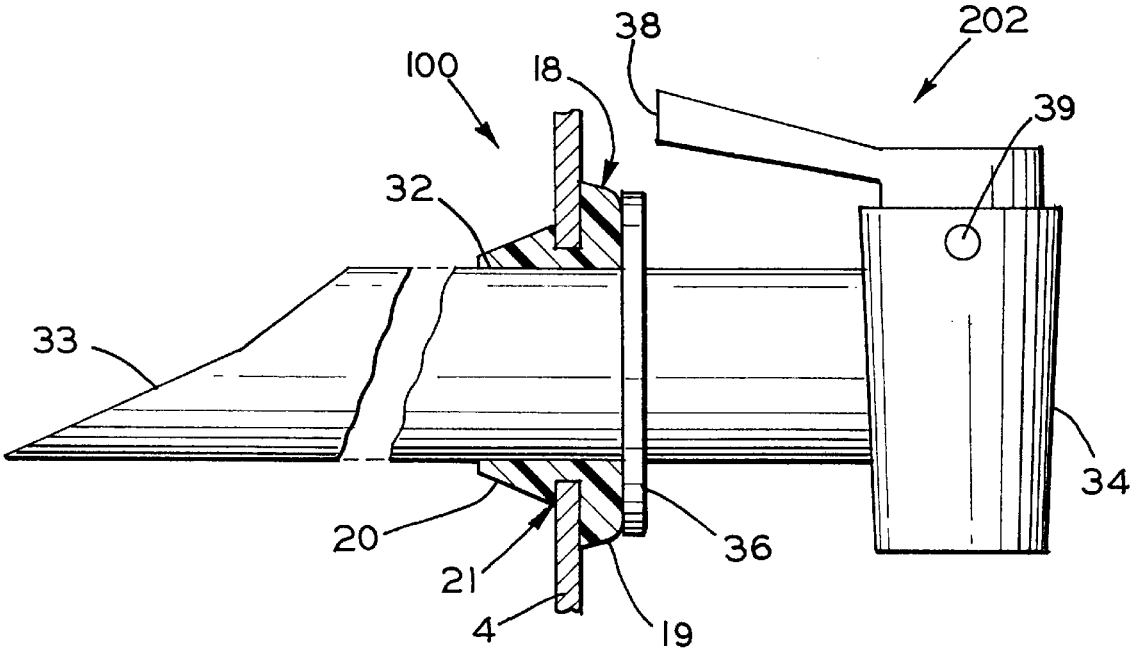
FIG. 10 is a cross sectional side view of the dispenser shown in FIG. 6 and a second embodiment of a dispensing key which has been inserted within the dispenser.

FIG. 10 shows a second embodiment of a dispensing key 202. Similarly to the first embodiment of the key 2 illustrated in FIGS. 4 and 5, this second embodiment includes a body 32 having a beveled spout or tip 33 on one end and a valve or other flow control means 34 on the opposite end. In the illustrated embodiment, the body 32 of the key 202 exerts an annular pressure against the inner recess 22 of the dispenser body 18 so as to secure the key 202 within the dispenser 200 and prevent the liquid from leaking from the container 1. The key 202 may also include a stopper 36 which functions to limit the distance the key 202 can be inserted into the dispenser 200. The valve 34 may be operated by a vertical lever 36. The lever 38 may be connected to the valve 34 by a bolt or pin 39 which allows the lever 38 to be operated so as to selectively open and close the valve 34. The operation of the lever 38 does not apply any lateral force on the dispenser 200. Consequently, no additional elements are needed on the dispenser 200 in order to secure it in place and avoid circular movement of the dispenser 200 and/or dispensing key 202.

Figure 11:
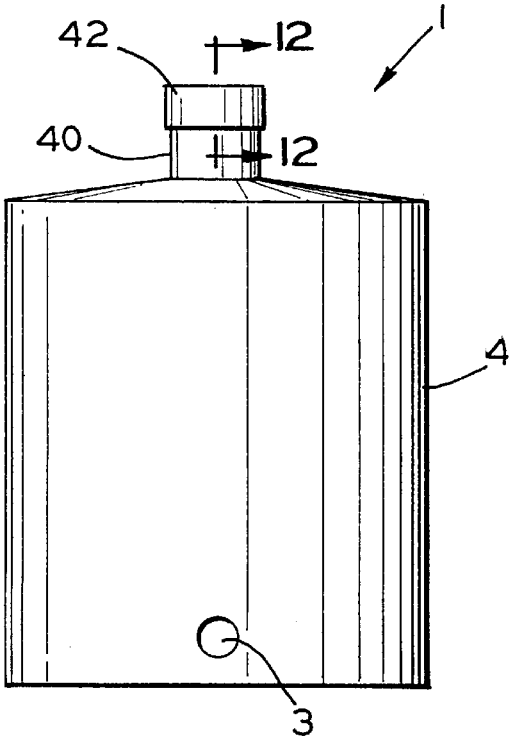
FIG. 11 is a side view of a rigid container having a sealing cap on the neck portion of the container in accordance with this invention.
Figure 12:
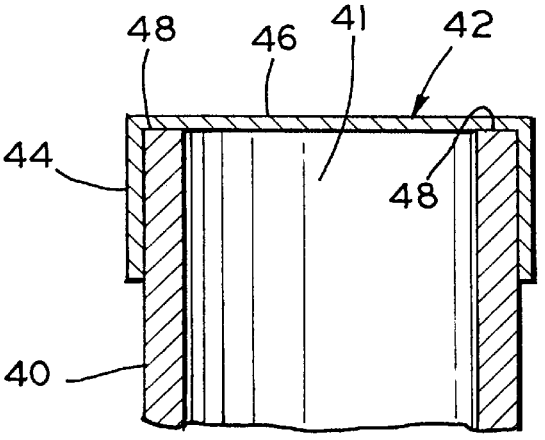
FIG. 12 is a detailed cross sectional side view of the neck portion of the container shown in FIG. 11.

The container 1 used with both embodiments of the dispenser 100 and 200 described above may be refillable. Referring to FIGS. 11 and 12, the refillable container 1 may include a filing neck 40 in the upper part of the container 1. The filling neck 40 may include a top opening 41 formed therein. The container 1 may also include a sealing cap/pressure controller 42 disposed on the filing neck 40 as shown in FIG. 11. The sealing cap 42 may be secured to the neck 40 through pressure by press fitting the cap 42 onto the neck 40. Alternatively, the cap 42 may be secured to the neck 40 through mating threads or threaded yarn placed inside the cap 42 and outside of the filing neck 40. This method allows the cap 42 to be placed on the neck 40 by rotation of the cap 42.

FIG. 12 is a detailed cross-sectional view of the filing neck 40 for a refillable container 1 with a sealing cap 42. As seen in FIG. 12, the sealing cap 42 may include a sidewall 44 which envelopes the outer periphery of the filling neck 40 and provides a seal therebetween. The sealing cap 42 may also include a top wall 46 which contacts the top edge 48 of the filling neck 40 and provides a seal therebetween. The sealing surfaces of the sidewall 44 and top wall 46 prevent the liquid from spilling out of the container 1. As further shown in FIG. 12, the material in the top wall 46 may be thinner than the material in the sidewall 44 so that the top wall 46 can be easily broken. The top wall 46 is broken to allow air into the container 1 and prevent negative pressure from forming within the container 1 when liquid is withdrawn from the container 1. It is important to note that with the container 1 described herein, air is in direct contact with the liquid once the top wall 46 is broken.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A dispenser adapted for use with a rigid container having a wall having an opening formed therethrough which communicates with an interior, said dispenser comprising:

a body including first and second outwardly extending flanges which define an annular outer recess therebetween, said annular outer recess adapted to receive a portion of the wall of the container therein so as to support said body within the opening of the container, said annular outer recess having a thickness approximately equal to a thickness of the container wall such that said first flange abuts an outer surface of the container wall and said second flange abuts an inner surface of the container wall, said body further having an inner recess formed in an inner portion of said body wherein said recess is adapted to receive a dispensing key therein; and a relatively thin membrane portion extending across said inner portion of said body, said relatively thin membrane portion adapted to be broken by the dispensing key when inserted within said inner recess to provide fluid communication with the interior of the container.

2. The dispenser defined in claim 1 wherein said second flange has a tapered cylindrical-shaped outer surface which allows said body to be inserted and withdrawn through the container opening.

3. The dispenser defined in claim 1 wherein said inner recess of said body has a protrusion extending inwardly therefrom, said protrusion being located on an end of said body which is opposite said breakable membrane.

4. The dispenser defined in claim 1 wherein said breakable membrane has a ring around an outer periphery of said breakable membrane, said ring being formed from a portion of said membrane which has a reduced thickness as compared to a thickness of the remaining portion of said membrane.

5. The dispenser defined in claim 2 wherein said breakable membrane has a ring around an outer periphery of said breakable membrane, said ring being formed from a portion of said membrane which has a reduced thickness as compared to a thickness of the remaining portion of said membrane.

6. A dispenser assembly adapted for use with a rigid container having a wall having an opening formed therethrough which communicates with an interior, said dispenser assembly comprising:

a hollow dispenser adapted to be received within the container opening, said dispenser having a body including first and second outwardly extending flanges which define an annular outer recess therebetween, said annular outer recess adapted to receive a portion of the wall of the container therein so as to support said body within the opening of the container, said annular outer recess having a thickness approximately equal to a thickness of the container wall such that said first flange abuts an outer surface of the container wall and said second flange abuts an inner surface of the container wall, said body further having an inner recess formed in an inner portion of said body, said dispenser further having a relatively thin breakable membrane portion extending across said inner portion of said body;

a key for dispensing the liquid in the container, said key being disposed within said inner recess of said dispenser body, said key including a hollow conduit having a beveled first end adapted to rupture said breakable membrane of said dispenser so as to dispense the liquid in the container.

7. The dispenser assembly defined in claim 6 wherein said second flange of said dispenser has a tapered outer surface which allows said body to be inserted and withdrawn through the container opening.

8. The dispenser assembly defined in claim 6 wherein said inner recess of said dispenser body has a protrusion extending inwardly therefrom, said protrusion being located on an end of said body which is opposite said breakable membrane.

9. The dispenser assembly defined in claim 6 wherein said breakable membrane has a ring around an outer periphery of said breakable membrane, said ring being formed from a portion of said membrane which has a reduced thickness as compared to a thickness of the remaining portion of said membrane.

10. The dispenser assembly defined in claim 6 wherein said dispensing key includes an annular disk disposed on an outer surface of said conduit, said disk abutting said outer flange of said dispenser and said dispensing key being press fit within said inner recess of said dispenser when said dispensing key is inserted within said inner recess of said dispenser.

11. The dispenser assembly defined in claim 8 wherein said dispensing key includes an annular disk and a ring disposed on an outer surface of said conduit, said ring being disposed between said disk and said first end of said conduit, said disk abutting said outer flange of said dispenser and said ring abutting said protrusion in said inner recess of said dispenser when said dispensing key is inserted within said inner recess of said dispenser.

12. The dispenser assembly defined in claim 10 wherein said dispensing key further includes a valve for controlling the dispensing of liquid in the container, said valve being disposed on an end of said conduit which is opposite said first end of said conduit.

13. A container assembly for a liquid comprising:

a rigid container having a wall having an bottom opening formed therethrough which communicates with an interior, said container further having a neck portion having a top opening formed therein;

a dispenser adapted to be received within said container bottom opening, said dispenser having a body including first and second outwardly extending flanges which define an annular outer recess therebetween, said annular outer recess adapted to receive a portion of said container wall therein so as to support said body within said container bottom opening, said annular outer recess having a thickness approximately equal to a thickness of the container wall such that said first flange abuts an outer surface of said container wall and said second flange abuts an inner surface of said container wall, said body further having an inner recess formed in an inner portion of said body, said dispenser further having a relatively thin breakable membrane portion extending across said inner portion of said body;

a key for dispensing the liquid in said container, said key being disposed within said inner recess of said dispenser body, said key including a hollow conduit having a beveled first end adapted to rupture said breakable membrane of said dispenser so as to dispense the liquid in said container.

14. The container assembly defined in claim 13 wherein said second flange of said dispenser has a tapered outer surface which allows said body to be inserted and withdrawn through said container bottom opening.

15. The container assembly defined in claim 13 wherein said inner recess of said dispenser body has a protrusion extending inwardly therefrom, said protrusion being located on an end of said body which is opposite said breakable membrane.

16. The container assembly defined in claim 13 wherein said breakable membrane has a ring around an outer periphery of said breakable membrane, said ring being formed from a portion of said membrane which has a reduced thickness as compared to a thickness of the remaining portion of said membrane.

17. The container assembly defined in claim 13 wherein said dispensing key includes an annular disk disposed on an outer surface of said conduit, said disk abutting said outer flange of said dispenser and said dispensing key being press fit within said inner recess of said dispenser when said dispensing key is inserted within said inner recess of said dispenser.

18. The container assembly defined in claim 13 wherein said dispensing key includes an annular disk and a ring disposed on an outer surface of said conduit, said ring being disposed between said disk and said first end of said conduit, said disk abutting said outer flange of said dispenser and said ring abutting said protrusion in said inner recess of said dispenser when said dispensing key is inserted within said inner recess of said dispenser.

19. The container assembly defined in claim 13 wherein said dispensing key further includes a valve for controlling the dispensing of liquid in said container, said valve being disposed on an end of said conduit which is opposite said first end of said conduit.

20. The container assembly defined in claim 13 further including a sealing cap disposed over said top opening in said neck portion of said container, said sealing cap having a sidewall which envelopes said neck portion and a top wall, said top wall having a thickness which is less than a thickness of said sealing cap sidewall.

* * * * *